United States Patent [19]

Cook et al.

[11] 4,130,150

[45] Dec. 19, 1978

[54] FINGER JOINTING MACHINE

[75] Inventors: Alan J. Cook, Bovingdon; Norman Brooks, Tring; Anthony D. Kirkby, Dunstable, all of England

[73] Assignee: Cook Bolinders Limited, Leighton Buzzard, England

[21] Appl. No.: 747,365

[22] Filed: Dec. 3, 1976

[51] Int. Cl.[2] ..... B27F 1/16

[52] U.S. Cl. ..... 144/2 R; 83/409; 83/437; 156/258; 156/304; 156/578; 144/90 A; 144/91; 144/198 R; 144/309 L; 144/314 B

[58] Field of Search ..... 144/1 R, 2 R, 3 R, 85, 144/89, 90 R, 90 A, 91, 198, 199, 200, 219, 314, 314 B, 315 R, 317, 326, 309L, 323; 83/437, 409, 414; 156/258, 517, 304, 578; 118/242, 243, 263, 241; 90/18, 21 R, 11 B, DIG. 26

[56] References Cited

U.S. PATENT DOCUMENTS

| | | | |
|---|---|---|---|
| 1,339,467 | 5/1920 | McConnel | 118/243 |
| 3,179,135 | 4/1965 | Windsor | 144/91 X |

FOREIGN PATENT DOCUMENTS

| | | | |
|---|---|---|---|
| 241094 | 11/1964 | Austria | 144/309 L |
| 1728384 | 12/1971 | Fed. Rep. of Germany | 144/90 A |
| 22763 | 5/1946 | Finland | 144/91 |

*Primary Examiner*—Othell M. Simpson
*Assistant Examiner*—W. D. Bray
*Attorney, Agent, or Firm*—Fleit & Jacobson

[57] ABSTRACT

A finger jointing machine in which timber is fed on a horizontal support table and is clamped against this table and against a vertical guide fence adjacent the table. The timber is clamped with the rear end of one piece of timber spaced from the front end of a second piece of timber at a defined spacing.

A cutting and gluing unit is movable vertically through the space and carries two rotatable cutters, rotatable about horizontal axes, each cutter having axially spaced teeth, the teeth of one cutter being axially spaced from those of the other by half the spacing between the teeth. The cutters are caused to rotate in opposite directions so that the teeth of one cutter engaging the rear end of the one piece of timber and the teeth of the other cutter engaging the front end of the other piece of timber are both moving upwardly as the cutting and gluing unit is caused to move upwardly. The cutting and gluing unit also includes two ribbed gluing rollers arranged one below each of the cutters, the ribs of the gluing rollers being disposed directly below the teeth of the cutter thereabove, so that they pass through the groove formed by the respective cutter thereabove. The cutting is effected by vertical upward movement of the cutters and support members are arranged which themselves have the shape of the fingers and prevent the wood from breaking out as the cutters pass up to the top surface. These cutters are retracted immediately after the cutters have gone by so that glue is not deposited thereon.

7 Claims, 3 Drawing Figures

FINGER JOINTING MACHINE

The present invention relates to finger jointing machines for jointing timber.

It has previously been proposed to join two lengths of timber to one another by cutting the ends of the timber with special cutters which form a series of deep V-shaped grooves thus forming fingers therebetween. The grooves are so shaped that they interfit with the fingers of the other piece of timber. Glue is applied to the fingers and the two pieces of timber are then pushed against one another by applying a very considerable force there between. When the glue is cured the timber can be very strong and can be as strong as 75% or more of the normal timber. The finger jointing is used when weaknesses in the timber appear, for example at the location of knots in the timber, the portion of timber having the knots or other weakness therein being cut out. The finger jointed timber is then significantly stronger than the timber with the knots therein. Thus, use can be made of timber which had faults therein and the resulting end product is substantially as strong as timber without any faults.

Various forms of cutters have been proposed and in one particular form two cutters are mounted on a cutting and gluing unit which is caused to move in a rectangular cyclical path. The two pieces of timber are arranged so that the ends to be joined are spaced from one another and the cutters are then caused to move downwardly through the timber, the sawdust being extracted by suitable means. As the cutting and gluing unit moves further down glue is applied, by gluing rollers arranged above the cutters, to the fingers formed by the cutters and then the cutting and gluing unit moves further down and sideways so that it is out of the line of the timber, which is then brought together firmly to complete the finger-jointing. The cutting and gluing unit then moves upwardly and sideways again, so that it is back to its initial position, and can then cut the next set of fingers and apply the glue thereto.

It is now proposed, according to the present invention, to provide a finger jointing machine comprising a horizontal support table; a vertical guide fence adjacent said support table; means for moving timber along said support table; means for clamping two pieces of timber on said support table and against said guide fence, with the rear end of one piece of timber spaced from the front end of the other piece of timber; a cutting and gluing unit movable vertically through the space between the ends of the timber clamped by said clamping means, said cutting and gluing unit including two rotatable cutters rotatable about horizontal axes, each cutter having axially spaced teeth, the teeth of one cutter being axially spaced from those of the other by half the spacing between the teeth of each cutter; means to rotate the cutters in opposite directions, whereby the teeth of one cutter engaging the rear end of said one piece of timber and the teeth of the other cutter engaging the front end of said other piece of timber are both moving upwardly and two ribbed gluing rollers arranged one below each of said cutters, the ribs being disposed directly below the teeth of the cutter thereabove and, means to move said cutting and gluing unit vertically upwardly past the rear end of said one piece of timber and the forward end of said other piece of timber, whereby when said pieces of timber are clamped by said clamping means, said unit cuts and glues interfitting fingers therein.

Such a construction has considerable advantages over the earlier described finger jointing machine. The timber which is fed into the finger jointing machine is usually unplaned, sawn timber which, although it has a nominal thickness and width which is the same, the actual thickness and width is not accurately the same. Using the apparatus according to the present invention, the timber is clamped against the worktable and against the vertical guide fence, which thus form two datum surfaces for the bottom and one side of each piece of timber. The two top surfaces of the timber will not necessarily be coplanar and the two side surfaces spaced from the guide fence may also not necessarily be coplanar. As the cutting and gluing unit moves upwardly, it therefore passes first through the face of the timber which forms the bottom datum plane. As it continues upwardly it will cut through the timber and will break out through the top face of the timber and at this point there will be a slight tendency for the timber to be broken away as the cutters come through. Thus, any breaking away takes place on the face of the timber which is not the datum face.

Therefore, when the joined timber moves on, through the machine, the bottom face will be substantially planar and there will be no break-out at the finger joints on this surface. Thus a very thin skin of planing on this bottom face will be sufficient to smooth this face off, thus wasting a minimum of timber. Any breakaway will be in the top face and this can be planed back a suitable distance which will in any event probably be necessary to ensure that the top faces of the two pieces of timber are coplanar.

It will be understood that it is important that the rear of the one piece of timber and the front end of the other piece of timber are correctly spaced as the cutters come up therethrough. This can be achieved in a particularly convenient manner with the construction according to the present invention in which an upper part of the cutting and gluing unit is provided with an abutment surface on its front and rear faces. Thus the first piece of timber is fed forwardly to a location which is forward of the vertical line of movement of the cutting and gluing unit. The cutting and gluing unit is then raised slightly so that the abutment face is in the path of movement of the timber. The forward piece of timber is then moved backward against the cutting and gluing unit abutment face and the rearward piece of timber is then moved forwardly against the other cutting and gluing unit abutment face. The two pieces of timber are then correctly spaced from one another. The cutting and gluing unit then moves upwardly to effect its cutting and gluing steps.

Naturally, there will be some tendency, even with such an arrangement, for there to be break-out of the timber as the cutters come upwardly therethrough. Thus, a preferred construction of machine according to the present invention has a support member located above the ends of each piece of timber as the cutters come up therethrough, these support members having fingers formed thereon which will overlie the fingers of the cut timber, the cutters passing upwardly in the grooves between the fingers of the support members. Thus, the fingers of the support members will firmly hold the fingers of the timber as they are being cut, and will minimize the amount of breakaway.

According to a preferred construction, the support members are movable out of the way once the cutters have gone by. The reason for this is that it is clearly of importance that the grooves between the fingers of the support members should not themselves be coated in glue. Furthermore, as the two pieces of timber are forces together, after gluing, it is important that the support members should not be themselves interengaged, because they would tend to diminish the loading between the pieces of timber.

Preferably, therefore, the support members are pivotal to an out-of-the-way position in which they extend vertically, instead of horizontally as they will be when they are holding the wood as the cutters pass therethrough.

In order that the present invention may more readily be understood, the following description is given, merely by way of example, reference being made to the accompanying drawings, in which.

Figure 1:
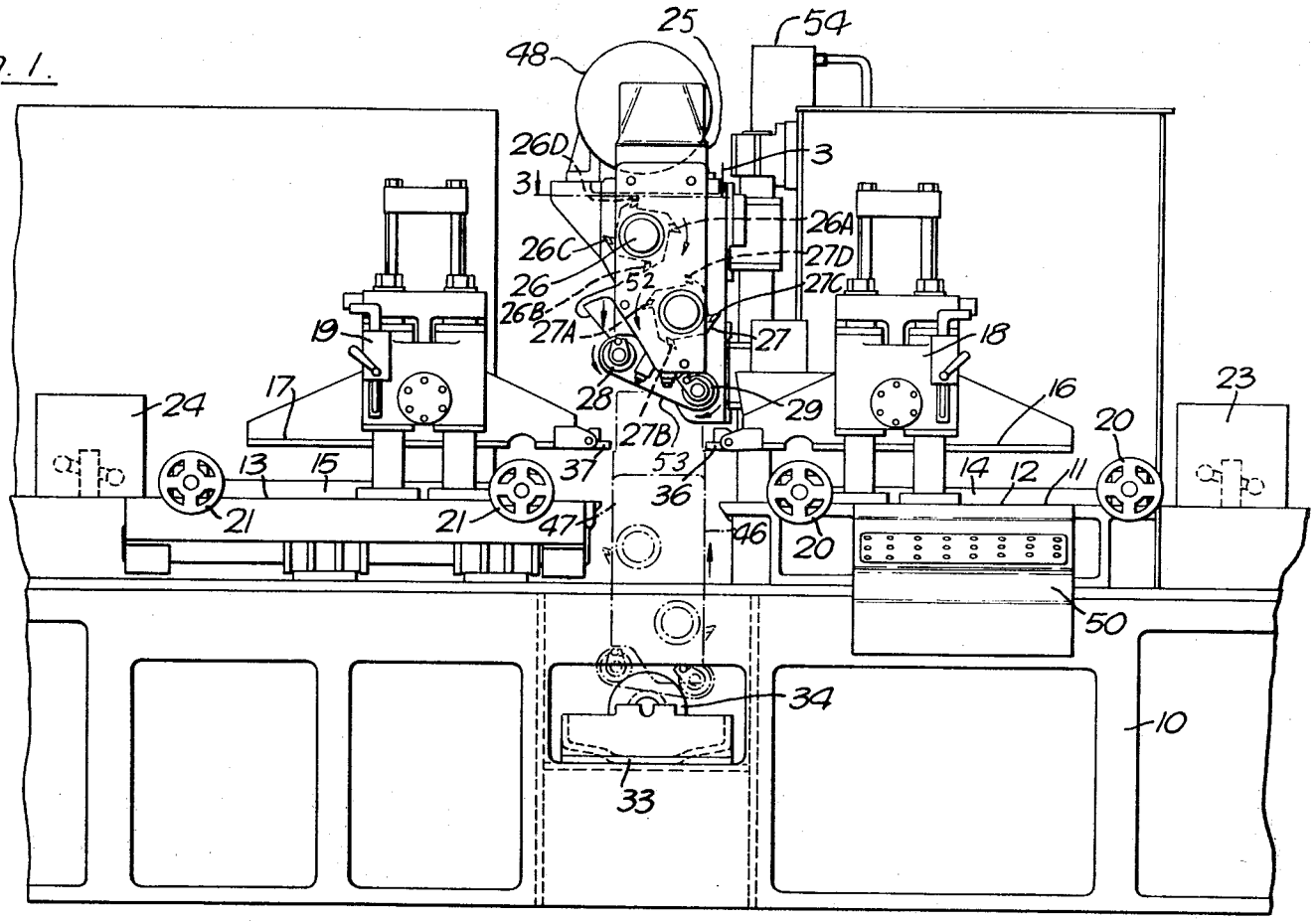
FIG. 1 is a side elevation, with parts shown in phantom, of one embodiment of finger jointing machine according to the invention.

The machine illustrated in FIG. 1 includes a frame 10 having an upper support table 11 formed as two horizontal aligned parts, that is a forward part 12 and a rearward part 13. Extending adjacent the support table parts 12 and 13 are parts of a vertical guide fence 14 and 15. Disposed above the forward horizontal table part 12 and the rearward table part 13 are two vertical clamping members 16 and 17 controlled by hydraulic mechanisms 18 and 19 respectively, whereby a forward piece of timber is clamped on the forward table part 12 and a rearward piece of timber may be clamped on the rearward table part 13.

Sideways clamping elements 20 and 21 are disposed to urge the timber sideways against the vertical guide fence, so that the timber is held against vertical and horizontal displacement once it is in position.

A forward feed mechanism 23 and a rearward feed mechanism 24 are disposed adjacent the horizontal table parts 12 and 13 for the movement of timber therealong.

Vertically slidable between the table parts 12 and 13 is a cutting and gluing unit 25, which has been indicated in full line in its uppermost position and in phantom in its lowermost position. The cutting and gluing unit includes two cutters 26 and 27 which are rotatable in the direction indicated by the arrows. Thus the cutter 26 rotates clockwise, so that the teeth engage the front end of the rearward piece of timber in an upwardly moving direction. Similarly the cutter 27 rotates in an anticlockwise direction so that its teeth engage the rear end of the forward piece of timber while moving in an upward direction. The carriage of the unit 25 is vertically movable along guideways which are not shown, by a hydraulic mechanism 54. Mounted below each of the cutters are gluing rollers 28 and 29 respectively. These are caused to rotate in the opposite sense to the cutters thereabove as indicated by the arrows.

Figure 3:
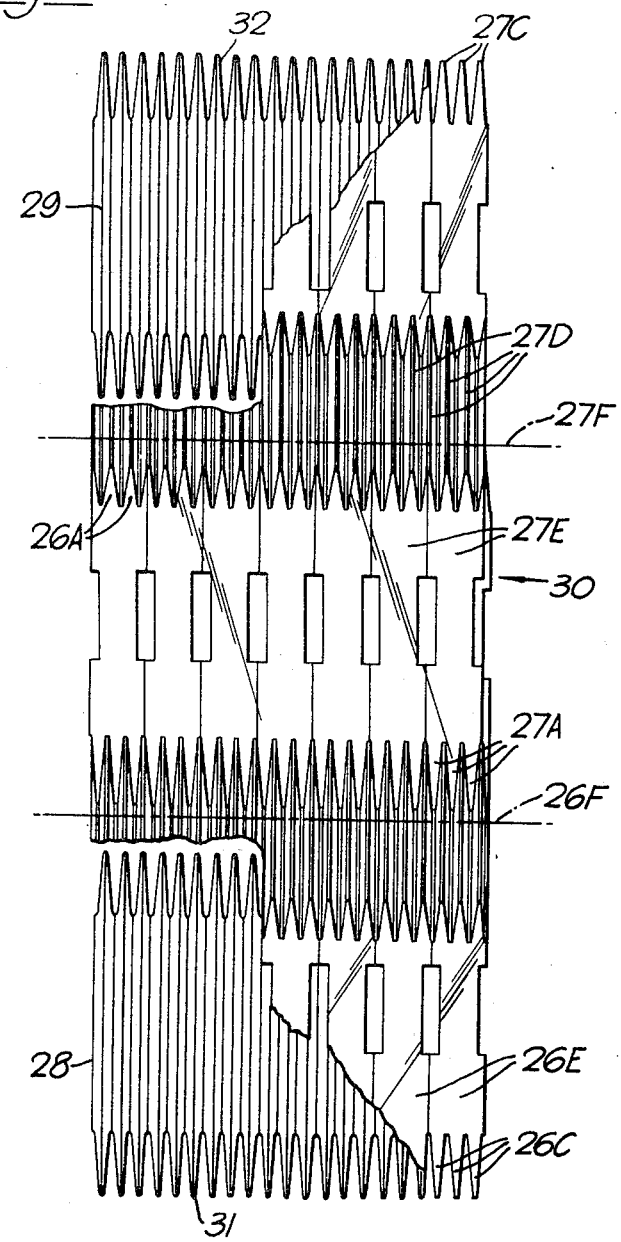
FIG. 3 is an enlarged plan view of the cutting and gluing assembly taken on the line 3—3 of FIG. 1, with parts broken away to illustrate the gluing rollers.

A better understanding of the form of the cutters and rollers will be had from studying FIGS. 1 and 3 together. As can be seen in FIG. 1 each of the cutters has four sets of teeth 26A, 26B, 26C, 26D and 27A, 27B, 27C, 27D. As can be seen in particular from FIG. 3, each of the cutters is made up of seven cutter elements 26E, 27E, each cutter element having twelve teeth, three at each location. Thus, in FIG. 3 there can be seen three teeth 27A, 27C, 27D on each element 27E, the three teeth 27B being hidden. The center lines of the two cutters are indicated as 26F and 27F respectively. as can be ssen, in particular on the righthand side in the zone marked by the general reference numeral 30, the teeth of the cutters 27 are axially offset with respect to the teeth of the cutters 26 by half the pitch between adjacent teeth of each of the cutters.

In FIG. 3 part of the cutters have been broken away to reveal the gluing rollers 28 and 29. It will be seen that the ribs 31 and 32 respectively on these gluing rollers are located immediately below the teeth of the cutter thereabove.

Arranged below the lowermost position of the cutting and gluing unit 25 is a glue tank 33 in which is rotatable a glue pick-up roller 34, so positioned that the gluing rollers 28 and 29 contact it at the lowermost position of the cutting and gluing unit 25.

Referring again to FIG. 1 it will be seen that the vertical clamps 18 and 19 carry retractable support members 36 and 37 respectively. The support member 36, which is substantially identical to the support member 37, can be seen more clearly in FIG. 2. It is pivotally mounted on a shaft 38 carried by the frame of the clamp 18 and is pivotable to the position 36A, shown in phantom, by means of a hydraulic piston and cylinder arrangement 40 connected thereto at 41.

At its end remote from the pivot the support member is provided with a plurality of fingers or teeth 42 having a shape to conform to the fingers cut by the cutters 26. As indicated the support member 37 is substantially identical, but its fingers or teeth are displaced parallel to the axis of the cutters by half the pitch between the teeth, so that the cutter teeth can pass therebetween.

The cutting and gluing unit 25 is provided with forward and rearward abutment faces 46 and 47 as can be seen in FIG. 1 also seen in FIG. 1 is a motor 48 for driving the cutters 26 and 27 and a motor 52 for driving the gluing rollers 28 and 29.

In operation with the cutting and gluing unit in its uppermost position as indicated in full-line in FIG. 1, the timber is fed in by the feed mechanism 24 over the support surface 13 and onto the support surface until its rearward end is to the right of the path of movement of the cutting and gluing unit. The cutting and gluing unit is then lowered, and a second piece of timber is fed forwardly by the feed mechanism 24 until it strikes the rear abutment face 47 on the cutting and gluing unit. At the same time the feed mechanism 23 feeds the first piece of timber backwardly until its rear edge abuts the forward abutment surface 46. The clamping mechanism 20 and 21 then forces the timber sideways against the guide fences 14 and 15 and the clamping members 18 and 19 move downwardly and clamp the timber firmly against the support table surfaces 12 and 13.

In this way the timber is clamped firmly against two datum surfaces, namely the table surface 12, 13 and the guide fence surface 14, 15.

The cutting and gluing unit then moves upwardly with the cutters and gluing rollers moving in the direction indicated. As the cutters move upwardly, they cut fingers in the rearward end of the forward piece of timber and the foward end of the rearward piece of timber, these fingers being axially offset by half a pitch. Means are provided to extract the sawdust from the assembly, so that it does not fall into the glue tank, these means being conventional sucking devices.

Figure 2:
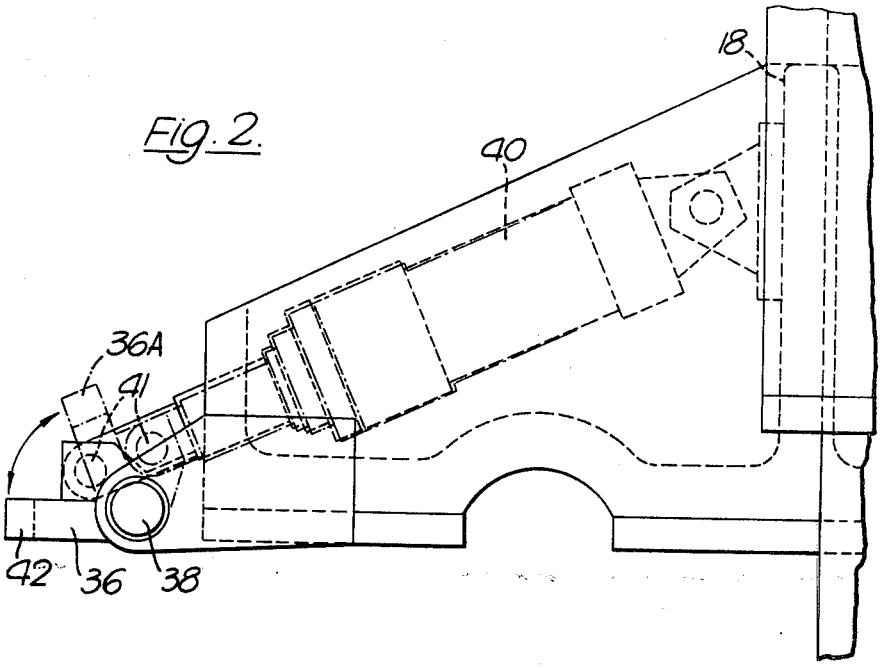
FIG. 2 is an enlarged side elevational view illustrating the movement of the support members.

The support members 36 and 37, during this cutting operation, are in the position indicated in FIG. 1 and in full line in FIG. 2. Thus, they clamp the wood immediately adjacent where the cutters are cutting. The cutters actually pass between the teeth of the cutting members and immediately after the cutters have cleared the wood and before the gluing rollers come into contact therewith, the support members 36 are pivoted to the out-of-the-way position indicated in phantom at 36A in FIG. 2. The gluing rollers, which were coated with glue by the glue applying roller 34 when the unit 25 was in its lowermost position then apply this glue to the fingers formed in the facing ends of the timber.

Once the cutting and gluing assembly has cleared the timber, the table 13 and its associated clamping elements 19, 21, 15 are moved by hydraulic means (not shown) to the right, so that the fingers of the timber clamped thereby are forced into engagement with the fingers of the timber clamped by the elements 12, 18, 20, 14. The arrangement is such that the fingers mesh under a pressure of up to twenty tons.

It will be appreciated that by using two bottom surfaces 12, 13 and two side surfaces 14, 15 which are accurately aligned and are maintained in alignment through the whole operation, and by utilizing cutters which are accurately axially offset by half a pitch of the teeth of the cutters. the fingers mesh perfectly. Since the datum surface 12, 13 is at the bottom and the cutters move upwardly, this bottom datum surface remains substantially unharmed and there is no breakaway at all on this bottom surface. Any breakaway will take place on the top surface. The tendency to break away will be significantly reduced by the provision of the support members 36, 37. These are caused to move away before there is any chance of glue being applied thereto which would obviously be unsatisfactory for the next finger jointing step. Furthermore, the fact that the support members are moved to an out-of-the-way position ensures that they do not take any of the load when the two pieces of timber are pushed into engagement by movement to the right of table 13 and its associated clamping elements.

The provision of the abutment surfaces 46, 47 on the cutting and gluing unit itself also ensures that the depth of cut of the fingers is accurate.

It will be understood that the other forms of retraction of these elements could be provided, for example, they could be movable linearly. However the pivoting arrangement is preferred because it ensures accurate overlying of the fingers of the cut wood by the fingers or teeth of the support members.

The whole cutting sequence can be programmed to take place automatically. A control panel 50 which can be used either for setting each individual step manually or for the automatic operation is mounted on the right hand support table 12.

The timber which has been jointed in the manner indicated is fed forwardly by the feed mechanism 23 and a further finger joint can be applied to the rear end of the timber which had been clamped on table 13 or alternatively further pieces could be joined together.

A sawing mechanism can be provided to the right of feed mechanism 23, if this is found necessary.

The wood which has been finger jointed has its lower surface and its rearward surface, which was against the fence 14, 15 flush throughout. Only a light planing operation will now be necessary on these two faces to remove any unevenness in the wood itself. A somewhat deeper planing operation would be necessary on the other two faces because the timber will not necessarily have been accurately sawn so that the two pieces of timber have identical dimensions. However, a significant saving in wood can be achieved and the deeper planing operation which is necessary on the top surface will also remove any breakout of the wood caused by the cutters.

We claim:

1. A finger jointing machine comprising, in combination:

(a) a horizontal support table;

(b) a vertical guide fence adjacent said support table;

(c) means for moving timber along said support table;

(d) means for clamping two pieces of timber on said support table and against said guide fence, with the rear end of one piece of timber spaced from the front end of the other piece of timber;

(e) a cutting and gluing unit movable vertically through the space between the ends of the timber clamped by said clamping means, said cutting and gluing unit including:

(i) two rotatable cutters rotatable about horizontal axes, each cutter having axially spaced teeth, the teeth of one cutter being axially spaced from those of the other by half the spacing between the teeth of each cutter;

(ii) means to rotate the cutters in opposite directions, whereby the teeth of one cutter engaging the rear end of said one piece of timber and the teeth of the other cutter engage the front end of said other piece of timber are both moving upwardly; and (iii) two ribbed gluing rollers arranged one below each of said cutters, the ribs of said gluing rollers being disposed directly below the teeth of the cutter thereabove; and (f) means to move said cutting and gluing unit vertically upwardly past the rear end of said one piece of timber and the forward end of said other piece of timber, whereby when said pieces of timber are clamped by said clamping means, said unit cuts and glues interfitting fingers therein.

2. A finger jointing machine as claimed in claim 1, and further comprising means to rotate said two ribbed gluing rollers in opposite directions, whereby the portions of the ribs of one roller engaging the rear end of said one piece of timber and the portions of the ribs of the other roller engaging the front end of said other piece of timber are both moving downwardly.

3. A finger joining machine as claimed in claim 1, and further comprising a glue tank arranged below said cutting and gluing unit and a glue pick-up roller rotatable in said tank for engagement by said gluing rollers when the cutting and gluing unit is at its lowermost position.

4. A finger jointing machine as claimed in claim 1, and further comprising support members mounted on said clamping means at a position to engage the timber above the portions thereof adjacent the spaced ends, and fingers on said support members disposed to overlie the fingers formed by the cutters.

5. A finger jointing machine as claimed in claim 4, and further comprising means to move said support members away from the path of movement of the gluing rollers after the cutters have moved past the support members.

6. A finger jointing machine as claimed in claim 5, and further comprising pivots holding said support members and means to pivot said support members from a substantially horizontal position in which they engage the timber to a substantially vertical position in which they are out of engagement with the timber.

7. A finger jointing machine as claimed in claim 1, in which said cutting and gluing unit includes abutments arranged above said cutters effective to define the spacing between the ends of the timber before they are clamped.

* * * * *